United States Patent [19]

Quinn

[11] Patent Number: 4,649,957

[45] Date of Patent: Mar. 17, 1987

[54] FLUID ASSISTED SPRING RETURN FOR PILOT OPERATED, SPOOL VALVE

[75] Inventor: Bryan J. Quinn, Fort Wayne, Ind.

[73] Assignee: The Aro Corporation, Bryan, Ohio

[21] Appl. No.: 822,817

[22] Filed: Jan. 27, 1986

[51] Int. Cl.[4] ..... F15B 13/044

[52] U.S. Cl. ..... 137/625.64; 137/625.66; 137/906

[58] Field of Search ..... 137/625.64, 625.66, 137/906

[56] References Cited

U.S. PATENT DOCUMENTS

| | | | |
|---|---|---|---|
| 3,015,317 | 1/1962 | Buchanan et al. | 137/625.62 |
| 3,706,322 | 12/1972 | Carlson | 137/625.66 |
| 3,958,495 | 5/1976 | Bernhoft | 137/625.66 X |
| 4,187,884 | 2/1980 | Loveless | 137/906 X |
| 4,257,572 | 3/1981 | Neff | 137/625.64 X |
| 4,267,862 | 5/1981 | Neff et al. | 137/625.64 |
| 4,524,803 | 6/1985 | Stoll et al. | 137/625.66 |

*Primary Examiner*—Gerald A. Michalsky

*Attorney, Agent, or Firm*—Allegretti, Newitt, Witcoff & McAndrews, Ltd.

[57] ABSTRACT

An improved pilot operated, spool valve includes a valve body with a spool that translates axially in a throughbore in the valve body. The spool is moved in response to air pressure in a first direction and is moved in the opposite direction by a combination of a mechanical biasing force and fluid pressure.

4 Claims, 3 Drawing Figures

FLUID ASSISTED SPRING RETURN FOR PILOT OPERATED, SPOOL VALVE

BACKGROUND OF THE INVENTION

This invention relates to an improved pilot operated, spool valve and, more particularly, to a pilot operated, spool valve having a spool which is moved in one direction by pilot air and in the opposite direction by a combination of mechanical biasing force and pilot air.

Heretofore there have been directional air valves utilizing a pilot operated spool. For example, in U.S. Pat. No. 4,267,862, there is disclosed a four-way directional air valve which incorporates an axially movable spool. A center exhaust port is arranged intermediate adjacent cylinder or outlet ports which, in turn, are arranged adjacent supply or inlet ports. Shifting of the spool is effected by means of pilot air in one direction and a mechanical biasing force or spring in the opposite direction.

A disadvantage with respect to such a construction is that under certain conditions the biasing spring may not provide a sufficient force to return or shift the spool once the pilot air is turned off. To overcome this problem, the spring constant of the spring may be increased. In such an instance, however, the pilot air required to move the spool against the force of the spring will increase thus making the valve useless for low pressure applications. Thus, there has existed the need and desire to provide a directional control air valve useful over a wide range of pressures.

SUMMARY OF THE INVENTION

Briefly the present invention comprises an improved pilot operated, spool valve which incorporates a valve body having a cylindrical throughbore and an associated slidable spool. The spool is operated by pilot air in one direction and operated in response to the combination of a mechanical biasing force and an air pressure force or air assist in the opposite direction. The air assist provides an initial force in combination with the mechanical biasing force; however, the air assist terminates as the spool translates axially in the valve body.

Thus, it is an object of the invention to provide an improved pilot operated, spool valve.

It is a further object of the invention to provide an improved spool valve wherein the movement of the spool in one direction is effected by means of fluid pressure alone and in the opposite direction by the combination of a mechanical biasing force and fluid pressure.

Still another object of the invention is to provide an improved spool valve wherein movement of the spool is effected in one direction by means of a large fluid pressurized surface area of the spool and in the opposite direction by means of air operating on a relatively smaller surface area in combination with force derived from mechanical biasing means.

Still another object of the invention is to provide an air assist for movement of the spool in a direction which is mechanically biased and wherein the air assist is provided during only a portion of the stroke associated with movement of the spool.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
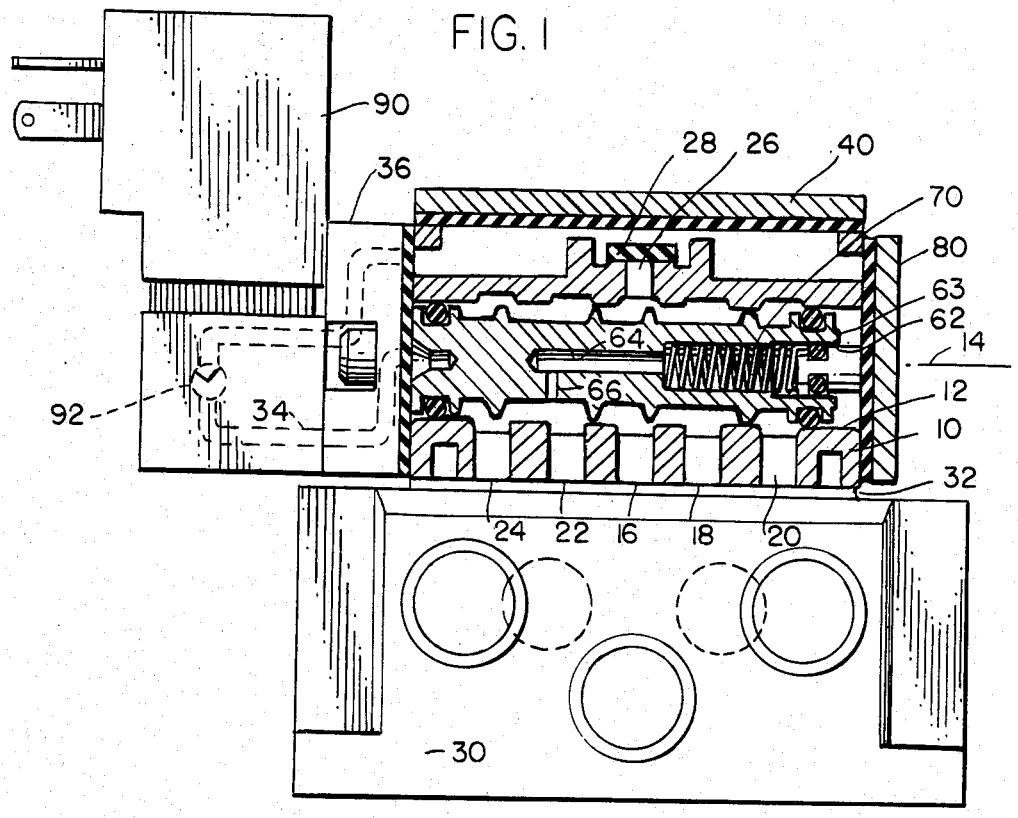
FIG. 1 is a cross sectional view of the improved spool valve of the present invention wherein the spool is in a position maintained by mechanical biasing means with no other forces operating on the spool to maintain it in position.

Referring to the figures, the valve of the present invention is a four-way, fluid operated, spool valve which includes a main body 10 having a generally cylindrical throughbore 12 defining a throughbore axis 14. Extending radially from the throughbore 12 are a series of five ports, 16, 18, 20, 22, and 24. Each of the ports 16, 18, 20, 22, 24 are equally spaced and equally sized. Thus, port 16 is equally spaced in an axial direction from ports 18 and 22. Ports 18 and 22 are equally spaced from ports 20 and 24 as well as port 16 in an axial direction. In the preferred embodiment, all of the ports 16, 18, 20, 22 and 24 extend radially in one direction from the throughbore 12. The ports 16, 18, 20, 22 and 24 are separated by lands 17, 19, 21 and 23 respectively.

A control passage 26 also connects the center of the throughbore 12 opposite port 16 to one end 25 of the body 10 adjacent port 24. A poppet 28 is positioned in the control passage 26 and defines a check valve. A cover 40 cooperates with a gasket seal 42 and is retained by machine screws 44 to help define the passage 26 which leads from the throughbore 12 and out an exit passage 46 in body 10 into an end manifold 36.

A first pilot passage inlet 34 is defined in manifold 36 and is connected through a gasket 38 to the one end 25 of the throughbore 12 of body 10 adjacent port 24. A solenoid operated, pilot valve assembly (described below) attached by bolt 94 and the manifold 36 attached by machine screws 37 are thus both attached to the end of the body 10. A control passage 47 and the inlet passage 34 connect through manifold 36 to the passage 46 and the end 25 of counterbore 12 respectively.

A generally cylindrical spool 50 fits within the generally cylindrical throughbore 12. The spool 50 includes four sealing flanges 52, 54, 56 and 57 which circumferentially encircle the spool 50. At the opposite ends of the spool 50 O-rings 58 and 60 fit within asssociated circumferential groove 59 and 61 respectively, to seal the ends of the spool 50 against lands 25 and 27 respectively defined in the opposite ends of throughbore 12. The O-rings 58 and 60 maintain a seal with the lands 25, 27 at all axial positions of the spool 50 in throughbore 12.

A first surface area 81 is defined at one end of the spool 50 transverse generally to axis 14. At the opposite end 63 of the spool 50 a counterbore 62 is defined with a connected axial passage 64. Passage 64, in turn, is connected with a radial passage 66 that exits between flanges 52 and 54. The radial passage 66 is adjacent or closer to the first surface 81 than it is to the opposite end 63 of the spool 50.

Positioned within the counterbore 62 is a spring 70. The spring 70 is held in place by a spring guide 72 which includes an O-ring 74 in a groove 76 thereby sealing the end of counterbore 62. The spring guide 72 is, in turn, held in position by a cover 80 that cooperates with a gasket seal 82 and is retained in position by machine screws 84.

A pilot valve 92 responsive to solenoid 90 is held by a bolt 94 against the manifold 36 with an intervening gasket seal 96. The valve 92 is shown in phantom and connects control passage 26 through passage 46 to the control inlet passage 34 for the manifold 36. The inlet passage 34 permits fluid to flow and provide pressure against the first surface 81 of the spool 50. Note that the first surface 81 of the spool 50 has a greater area than the effective surface area of the counterbore 62 transverse to axis 14. Thus, if both effective surfaces, i.e., surface 61 and the surface of counterbore 62 transverse to axis 14, are pressurized and spring 70 has a sufficiently low spring constant, the spool 50 will move axially to the right in the figures.

Figure 2:
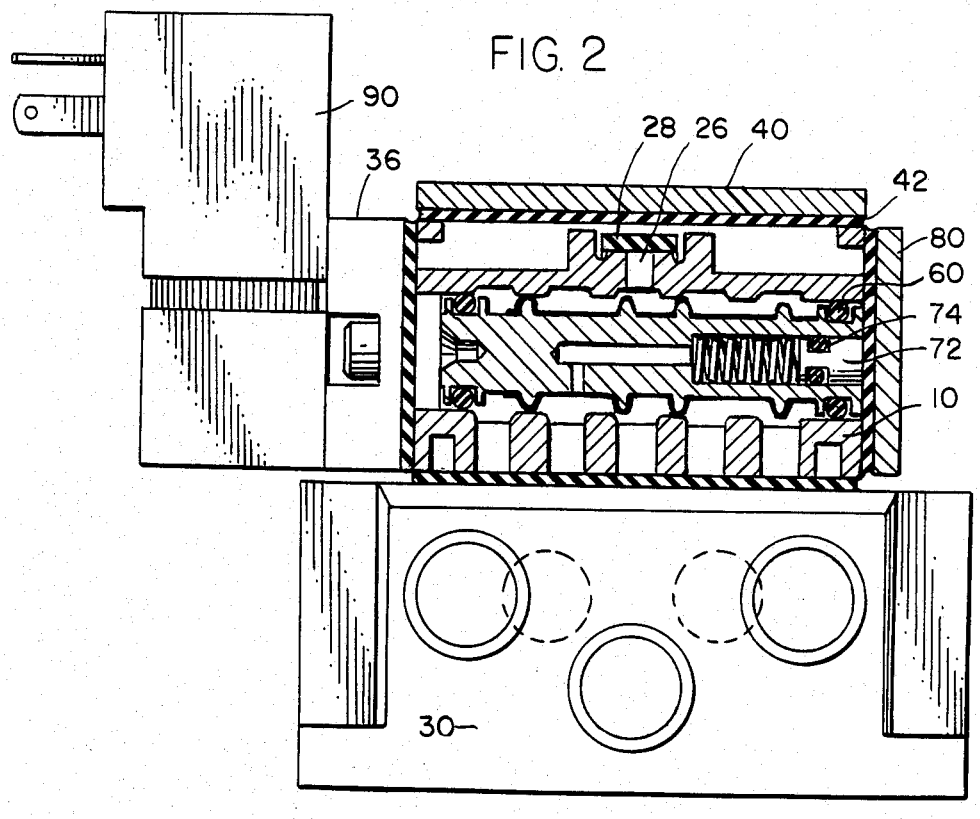
FIG. 2 is a side cross sectional view of the valve of FIG. 1 wherein the spool has been translated by means of fluid pressure operating on the spool in opposition to fluid pressure associated with mechanically biasing means as well as the air assist.
Figure 3:
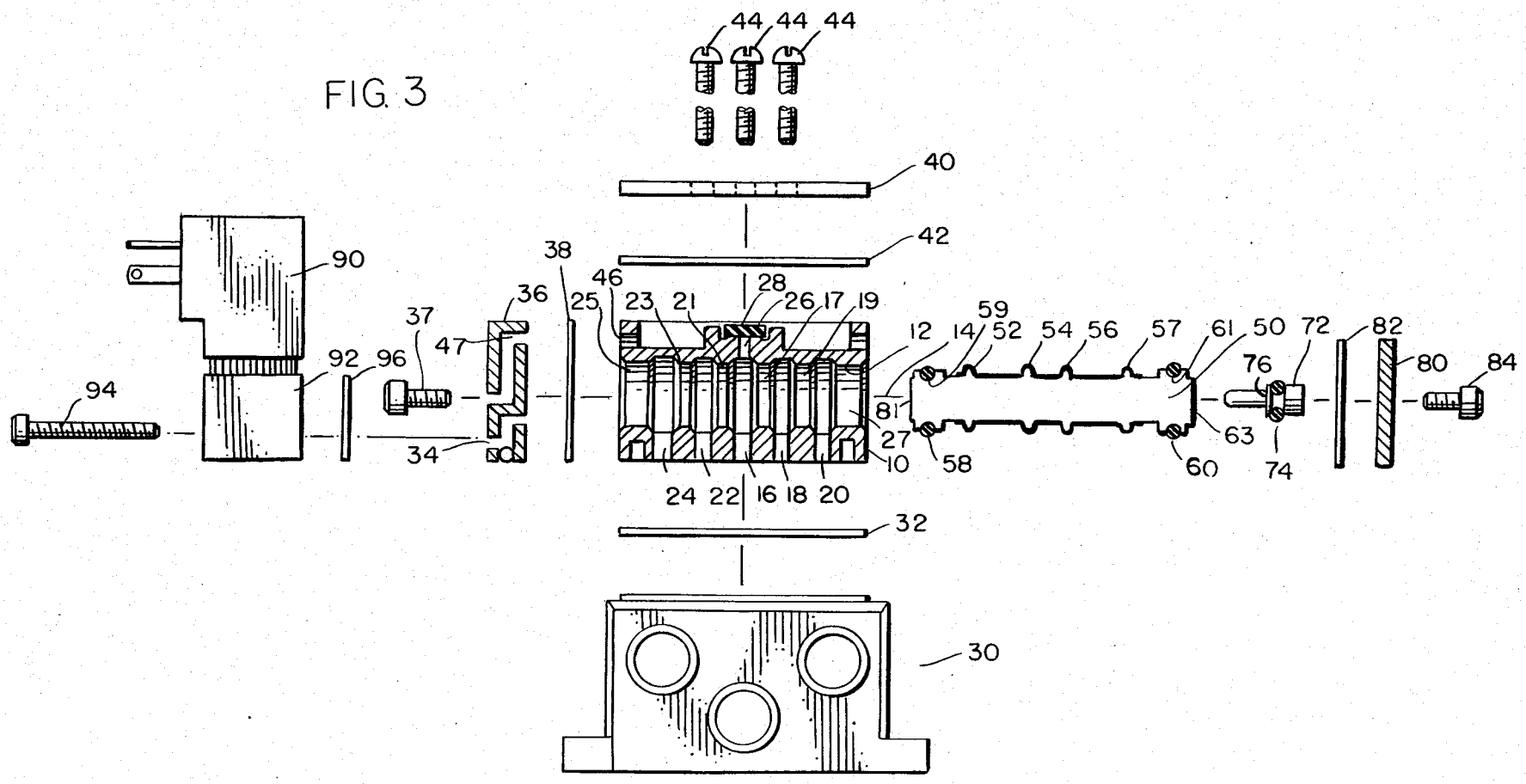
FIG. 3 is an exploded, partial sectional side elevation of the valve of FIGS. 1 and 2.

Referring to FIGS. 1 and 2, the remaining structure and operation of the improved valve of the present invention is described. Referring first to FIG. 1, the center port 16 is the fluid pressure inlet port. The adjacent ports 18 and 22 define outlet ports. The outside ports 20 and 24 are exhaust ports.

Though the ports 16, 18, 20, 22, 24 of the body 10 are equally spaced, the associated flanges 54 and 56, 52 and 57 of spool 50 are unequally spaced. That is, flanges 54 and 57 are spaced so that when the spool 50 is in the position shown in FIG. 1, flange 54 will seal against land 21 while simultaneously flange 57 will seal against land 19. This arrangement and position of the spool 50 is effected when the solenoid operated pilot valve 92 is in the "off" position so that no pressurized fluid will flow to act on surface 61 of the spool. When in this "off" position, the spring 70 maintains the spool 50 as shown in FIG. 1 since the biasing force of the spring 70 forces the spool 50 to the left in FIG. 1. When the spool 50 is as described and depicted in FIG. 1, pressurized fluid will flow through the inlet 16 and from the outlet 18. The second outlet 22 is simultaneously connected to the exhaust port 24. Likewise, the internal cavity or counterbore 62 is connected to the exhaust port 24 when in this position through passage 64.

When the pilot valve 92 is operated via solenoid 90, for example, pressurized fluid will flow against the surface 61 causing the spool 50 to translate to the right in the figures. As spool 50 translates to the right, the flanges 52 and 56 will seal against lands 23 and 17 respectively. The flanges 54 and 57 will simultaneously become unsealed from their respective lands 21 and 19. As a result, as the spool 50 translates to the right in FIG. 2, prssurized fluid will flow through the inlet port 16 and out the outlet port 22. The outlet port 22 will simultaneously be sealed from the exhaust port 24. At the same time the other outlet port 18 will be connected with the exhaust port 20. Pressurized fluid will also flow into the radial passage 66 and then into the connecting axial passage and counterbore 62. The flow of pressurized fluid into passage 64 is constricted, however, due to the diameter of the radial passage 66. Thus, fluid pressure within the cavity or counterbore 62 will not build up in a sufficiently quick manner to inhibit translation of the spool 50.

When the spool 50 has been translated fully to the right as shown in FIG. 2, an equilibrium of pressure builds within the system. Nonetheless, the cumulative force due to pressure on the surface area of the counterbore 62 as well as the force derived from the spring 70 is insufficient to overcome the force due to the pressure on the surface area 61. Spool 50 will therefore remain in the position depicted in FIG. 2.

Removal of the pressure from the first surface area 61 will, however, permit the spool 50 to again translate to the left as shown in FIG. 2. Translation to the position shown in FIG. 1 is effected by the air assist associated with the pressurized air in the counterbore cavity 62 in combination with the mechanical biasing force of the spring 70. Note that pressurized air cannot quickly bleed through the passage 64, thereby assuring force due to air assist pressure in counterbore 62.

By varying the spring constant of the spring 70 as well as the size of the radial opening or passage 64 and the surface areas of the first area 61 and the effective pressurized area of the counterbore 62, it is possible to adjust the effect of the air assist associated with movement of the spool 50. Also, by carefully positioning the opening 66 along the axis 14 of spool 50 as well as carefully defining the axial position of the various flanges 52 and 54, 56 and 57, it is possible to control when the air assist will become effective and the extent to which it will be effective in order to translate the spool 50.

It is possible to vary the valve mechanism which controls the input of air against the surface 61. The use of poppet or check valve 28 may also be eliminated. The type and number of ports associated with the body 10 may also be varied. Thus, while there has been set forth a preferred embodiment of the invention, it is to be understood that the invention is to be limited only by the following claims and their equivalents.

What is claimed is:

1. An improved pilot operated spool valve comprising, in combination:

a body having a generally cylindrical throughbore defining an axis, a series of five ports extending radially from the throughbore including a center port, adjacent ports to the center port and next adjacent ports, each of said ports axially spaced an equal distance one from the other and each of said ports being substantially equally sized the center port comprising a fluid inlet, the adjacent ports comprisng fluid outlets, the next adjacent ports comprising fluid exhaust ports and one end of the throughbore comprising a first pilot port;

a slidable spool in the throughbore, said spool including a series of four axially spaced sealing flanges intermediate the ends of the spool and also including sealing means for the opposite ends of the spool in the throughbore to maintain a seal between the spool and said bore as said spool slides in the bore between the limits of axial movement of the spool, a first surface at one end of the spool connected with the first pilot port defining an area cooperative with fluid pressure to provide a force in a first axial direction, said first pilot port connected to the inlet port through a connecting passage in the body;

said flanges being unequally spaced to seal the center inlet port from one of the adjacent outlet ports while simultaneously sealing the other adjacent outlet port from its adjacent exhaust port whenever the spool is transported to an axial limit whereby the inlet port is connected to one outlet port and the other outlet port is connected to its adjacent exhaust port, and vice versa when the spool is transported to the opposite axial limit; and a pilot, axial counterbore in the spool at the end of the spool opposite the first surface, a pilot passage connected to the counterbore from intermediate the adjacent pair of spaced flanges axially closest to the first end of the spool;

and biasing means and biasing guide means in the counterbore for biasing the spool axially in the opposite direction, said biasing means acting in combination with fluid pressure on a surface area of the counterbore whenever the spool is translated in the first axial direction to an axial position wherein the inlet port connects to the one outlet port, said biasing means being retained and sealed within the counterbore and acting through the biasing guide means against the body.

2. The pilot operated spool valve of claim 1 including a pilot control valve in the connecting passage.

3. The spool valve of claim 2 including a check valve in the connecting passage to prevent fluid back flow from the control valve.

4. The spool valve of claim 1 wherein said spool includes an axial counterbore opposite said first surface, a spring member in the counterbore as biasing means, and a spring guide as biasing guide means for maintaining the spring member biased against the spool, said guide also including means for sealing the counterbore to define an internal cavity connected through the pilot passage only.

* * * * *